US009482142B2

(12) United States Patent
Paetkau et al.

(10) Patent No.: US 9,482,142 B2
(45) Date of Patent: Nov. 1, 2016

(54) COOLING SYSTEM FOR AN ELECTRIC VEHICLE AND METHOD FOR PRODUCING A COOLING SYSTEM

(71) Applicant: Robert Bosch GmbH, Stuttgart (DE)

(72) Inventors: Vitali Paetkau, Leonberg (DE); Milos Medvecky, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 95 days.

(21) Appl. No.: 14/522,841

(22) Filed: Oct. 24, 2014

(65) Prior Publication Data

US 2015/0114323 A1 Apr. 30, 2015

(30) Foreign Application Priority Data

Oct. 24, 2013 (DE) ..... 10 2013 221 640

(51) Int. Cl.

| | |
|---|---|
| ***F02B 63/00*** | (2006.01) |
| ***F01P 3/20*** | (2006.01) |
| *F02B 77/13* | (2006.01) |
| *F02B 75/16* | (2006.01) |
| *F02B 63/04* | (2006.01) |

(52) U.S. Cl.

CPC ..... *F01P 3/20* (2013.01); *F02B 63/04* (2013.01); *F01P 2050/24* (2013.01); *F02B 63/044* (2013.01); *F02B 75/16* (2013.01); *F02B 77/13* (2013.01); *F02B 2063/045* (2013.01)

(58) Field of Classification Search

CPC F02B 63/04; F02B 2063/045; F02B 63/044; F02B 77/13; F02B 75/16

USPC ..... 123/2

See application file for complete search history.

(56) References Cited

U.S. PATENT DOCUMENTS 7,649,273 B2 * 1/2010 Zillmer ..... B60K 6/485 123/41.31

2012/0253579 A1 10/2012 Groeter

* cited by examiner

*Primary Examiner* — Lindsay Low
*Assistant Examiner* — Charles Brauch
(74) *Attorney, Agent, or Firm* — Michael Best & Friedrich LLP

(57) ABSTRACT

A cooling system for thermal management of an electric vehicle having a range extender. The temperature of the components of the electric drive system of the electric vehicle and at least that of the internal combustion engine of an internal combustion engine/generator unit of the range extender are controlled by separate cooling circuits. The cooling circuit of the electric drive and the cooling circuit of the internal combustion engine are coupled to one another thermally by a heat exchanger.

16 Claims, 4 Drawing Sheets

COOLING SYSTEM FOR AN ELECTRIC VEHICLE AND METHOD FOR PRODUCING A COOLING SYSTEM

BACKGROUND OF THE INVENTION

The present invention relates to a cooling system for an electric vehicle and to a method for producing a cooling system. In particular, the present invention relates to a cooling system for an electric vehicle having an electric drive and an internal combustion engine.

Electric vehicles, which are driven by means of an electric motor, are known. Here, the electric energy required to operate the electric motor in order to drive the electric vehicle in this context is preferably provided by a battery arranged in the electric vehicle. In this case, said battery must be charged at regular intervals from an external power supply system while the electric vehicle is stationary. However, the capacity of the battery for storing the required electric energy is limited. Currently available electric vehicles generally have a battery which allows a range of about 50 km to about 200 km before the battery must be recharged.

To increase the range of an electric vehicle, "range extenders" are furthermore known. This is an internal combustion engine/generator unit. By means of a range extender of this kind, the electric vehicle can be supplied with additional electric energy by means of the internal combustion engine/generator unit in the case of longer distances of travel, it being possible for this energy to be used to charge the battery or for it to be supplied directly to the electric motor.

German Patent Application DE 10 2009 054 839 A1 discloses a range extender having an internal combustion engine/generator unit for an electric vehicle, wherein the generator initially produces an alternating current, which is then rectified, and wherein the voltage of the direct current is controlled by adapting the rotational speed of the generator.

In the case of range extenders of this kind, heat is generated by the internal combustion engine of the internal combustion engine/generator unit during the operation of the range extender, and this must be released into the environment in order to cool the range extender. For this purpose, a corresponding cooling system is required to cool the range extender.

There is therefore a requirement for a compact and efficient cooling system for an electric vehicle having an internal combustion engine/generator unit.

SUMMARY OF THE INVENTION

According to a first aspect, the present invention achieves this object by providing a cooling system for an electric vehicle having an electric drive and an internal combustion engine, having a first cooling circuit, which is designed to control the temperature of the electric drive; a second cooling circuit, which is designed to control the temperature of the internal combustion engine; and a heat exchanger, which is designed to couple the first cooling circuit and the second cooling circuit thermally to one another.

According to a further aspect, the present invention provides a method for operating a cooling system for an electric vehicle having an electric drive and an internal combustion engine, having the following steps: controlling the temperature of the electric drive by means of a first cooling circuit; controlling the temperature of the internal combustion engine by means of a second cooling circuit; and thermally coupling the first cooling circuit to the second cooling circuit by means of a heat exchanger.

Here, the concept underlying the present invention is that of cooling or controlling the temperature of the components of the electric drive of an electric vehicle and the components of the internal combustion engine/generator unit of a range extender by means of separate cooling circuits. In this arrangement, these two separate cooling circuits are coupled to one another by means of a heat exchanger. Through this thermal coupling of the two cooling circuits by means of a heat exchanger, it is possible to take account of the different operating temperatures of the drive components of the electric vehicle and of the range extender.

This mode of construction makes it possible to achieve the temperature regulation of the internal combustion engine by means of a simple thermostat. In addition, there is the possibility of controlling the temperature of the internal combustion engine while it is stationary using the waste heat from the drive components of the electric drive system and to increase both the overall efficiency and also the life of the internal combustion engine.

Since the cooling circuit of the internal combustion engine initially releases its heat to the main cooling circuit of the electric drive system by means of the heat exchanger, no additional radiator or the like is required for this cooling circuit of the internal combustion engine in order to release the heat to the environment. Thus, the required components for this cooling circuit can be reduced, and a compact and low-cost construction of the cooling system is made possible.

Since the electric drive and the range extender are operated by means of separate cooling circuits, the maintenance of the overall system is furthermore also simplified. Both the replacement of a faulty range extender by a new range extender and also the complete removal of the range extender and continued operation of the electric vehicle without the range extender are thus particularly simple possibilities.

In one embodiment, a first coolant flows through the first cooling circuit, and a second coolant flows through the second cooling circuit. Here, the first coolant and/or the second coolant is preferably water. If appropriate, further additives can be added to this water in order to ensure corrosion protection or to increase the boiling point of the water, for example. Other coolants, in particular other liquid coolants, are furthermore likewise possible.

In one embodiment, the first cooling circuit furthermore has a heat dissipation device, which is designed to release heat from the first cooling circuit into the environment. This heat dissipation device can be a heat exchanger, for example, through which the coolant of the first cooling circuit flows and which releases the heat to the ambient air. By means of this heat dissipation device, the heat from the first cooling circuit can therefore be released directly to the environment. It is furthermore possible, by means of this heat dissipation device, to release the waste heat from the internal combustion engine indirectly to the environment, using the heat exchanger between the first and the second cooling circuit as an intermediate stage. The internal combustion engine of the internal combustion engine/generator unit of the range extender can thereby be cooled without a separate liquid/air cooling device in the cooling circuit of the internal combustion engine/generator unit. In this way, the number of component elements required for a range extender is reduced, and the overall size and the weight of the range extender can also be minimized.

Another aspect of the present invention relates to an electric vehicle having an electric drive, an internal combustion engine and a cooling system according to the invention.

In one embodiment, the electric vehicle furthermore has a generator, which is coupled to the internal combustion engine and is designed to provide electric energy; and a power electronics unit, which is designed to convert the electric energy provided by the generator. In particular, the power electronics unit can convert the electric energy provided by the generator to charge a traction battery of the electric vehicle or can convert the electric energy directly for the drive system of the electric vehicle.

In one embodiment, the first cooling circuit is furthermore designed to control the temperature of the generator and/or of the power electronics unit. Thus, the power electronics unit of the internal combustion engine/generator unit can be heated or cooled to the required operating temperature directly by the first cooling circuit.

In an alternative embodiment, the second cooling circuit is furthermore designed to control the temperature of the generator and/or of the power electronics unit. By including the generator and/or the power electronics unit in the second cooling circuit, which also cools the internal combustion engine of the range extender, only a single interface by means of the heat exchanger is thus required between the internal combustion engine/generator unit and the first cooling circuit. This makes possible particularly simple coupling between the cooling system of the internal combustion engine/generator unit and the cooling system of the electric drive.

In one embodiment, the first cooling circuit furthermore has a heating device, which is designed to heat a coolant in the first cooling circuit. This heating device can be an electric additional heater, for example. By means of this additional heating device, the first cooling circuit can be heated very quickly to a desired operating temperature. This is advantageous particularly if the first cooling circuit is also simultaneously to be used to heat the passenger compartment on cool days, for example. By means of the rapid heating of the first cooling circuit, it is thus also possible to heat all the operating components of the electric vehicle very quickly to an optimum operating temperature, improving both the life of the components and the efficiency of the overall system.

In one embodiment, the heat exchanger is arranged after the heating device as viewed in the direction of flow of the coolant. Thus, the heat exchanger can be made to share in a particularly effective manner in the heat output of the heating device, and the heat provided by the heating device can also be used in a particularly efficient manner in the second cooling circuit to heat the components.

BRIEF DESCRIPTION OF THE DRAWINGS

Further embodiments and advantages of the present invention will become apparent from the following description with reference to the attached drawings, in which.

DETAILED DESCRIPTION

Figure 1:
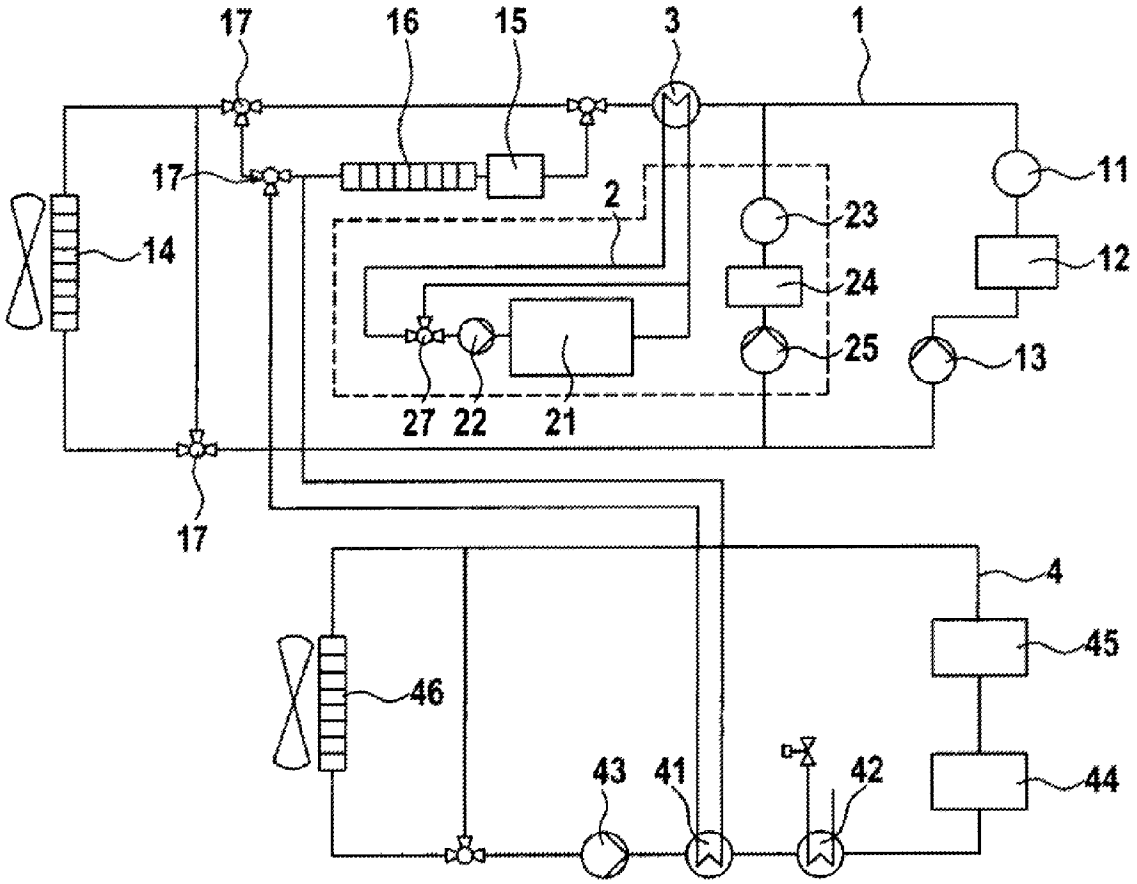
FIG. 1: shows a schematic representation of a topology of a cooling system according to a first illustrative embodiment.

FIG. 1 shows a schematic representation of the topology of a cooling system according to a first illustrative embodiment. Here, a first cooling circuit cools the components of the electric drive 11 and also the corresponding components of the associated power electronics unit 12, e.g. of the drive inverter. For this purpose, a preferably liquid coolant is pumped through the cooling circuit by means of a pump 13. In this case, the heat arising in this cooling circuit 1 is released to the environment, in particular to the ambient air, by means of a heat dissipation device 14. The heat dissipation device 14 can be a water/air heat exchanger, for example. Of course, different heat dissipation devices that can release the heat from the first cooling circuit 1 to the environment are furthermore likewise possible. A heating device 15 can furthermore also be integrated into the first cooling circuit 1. This heating device 15 can be an electric heating device, for example. An electric heating device of this kind can be a PTC heating device, for example, which comprises a resistance wire having a positive temperature coefficient. A further heat dissipation device 16 can furthermore also be arranged in the first heating circuit 1 in order to heat the passenger compartment. This further heat dissipation device 16 is preferably arranged after the heating device 15 in the direction of flow of the coolant. To control the flow of the coolant in the first heating circuit 1, the heating circuit 1 furthermore comprises a plurality of control valves 17.

The cooling system furthermore comprises a second heating circuit 2. Here, it is, in particular, the internal combustion engine 21 of the internal combustion engine/generator unit of the range extender which is cooled by means of this second heating circuit 2. For this purpose, a second coolant, e.g. water or some other liquid coolant, is pumped through the second cooling circuit 2 by means of a pump 22. Here, the temperature in this second heating circuit 2 can be controlled by means of a thermostatic valve 27. In this case, the second heating circuit 2 is coupled to the first cooling circuit 1 by means of a heat exchanger 3. For this purpose, the heat exchanger 3 has two connection sides. In this case, a first connection side, e.g. a primary side of the heat exchanger 3, is connected to the first heating circuit 1. The second connection side, e.g. a secondary side of the heat exchanger 3, is furthermore connected to the second heating circuit 2. Thus, thermal coupling of the first heating circuit 1 with the second heating circuit 2 is possible without the coolants in the two heating circuits 1, 2 coming into contact.

As illustrated in FIG. 1, the heat exchanger 3 is here arranged between components 11 and 12 of the electric drive system and the heat dissipation device 14, as viewed in the direction of flow of the coolant. During a warm-up phase, the waste heat from the electric drive system can thus be used to heat the internal combustion engine 21. If, on the other hand, the internal combustion engine 21 is at the operating temperature, the waste heat from the internal combustion engine 21 can be released into the first cooling circuit 1 by means of the heat exchanger 3 without this waste heat overheating components 11 and 12 of the electric drive system. Once the waste heat from the second cooling circuit has been fed into the coolant in the first cooling circuit 1, the coolant flows through the heat dissipation device 14 and is cooled down again there before the coolant, which has then been cooled, is pumped onward to the components of the electric drive system.

If the passenger compartment is also to be heated by means of the first cooling circuit 1, the heat exchanger can be arranged ahead of the further heat dissipation device 16 for heating the vehicle interior, as viewed in the direction of flow of the coolant, within the first cooling circuit. In this case, the waste heat from the second cooling circuit can additionally be used to heat the vehicle interior.

In the illustrative embodiment in FIG. 1, the other components of the range extender, e.g. the generator 23, the power electronics unit 24 etc., are connected to the first heating circuit 1. Here, the coolant in the first heating circuit is pumped through these additional components 23 and 24 of the range extender by means of a separate pump 25.

As can furthermore also be seen from FIG. 1, the components of the battery system have a separate cooling system 4, which is likewise coupled to the first cooling circuit 1 by means of a further heat exchanger 41. This cooling circuit 4 furthermore comprises a further heat exchanger 42, which is connected to an air-conditioning system or to a suitable cooling device. The coolant in this separate cooling circuit 4 is pumped through the cooling circuit 4 by means of a pump 43 and, in the process, cools the battery 44 and the power electronics unit 45 of the battery system. This separate cooling circuit 4 furthermore has a dedicated heat dissipation device 46, by means of which the heat of the further cooling circuit 4 can be released to the environment.

Figure 2:
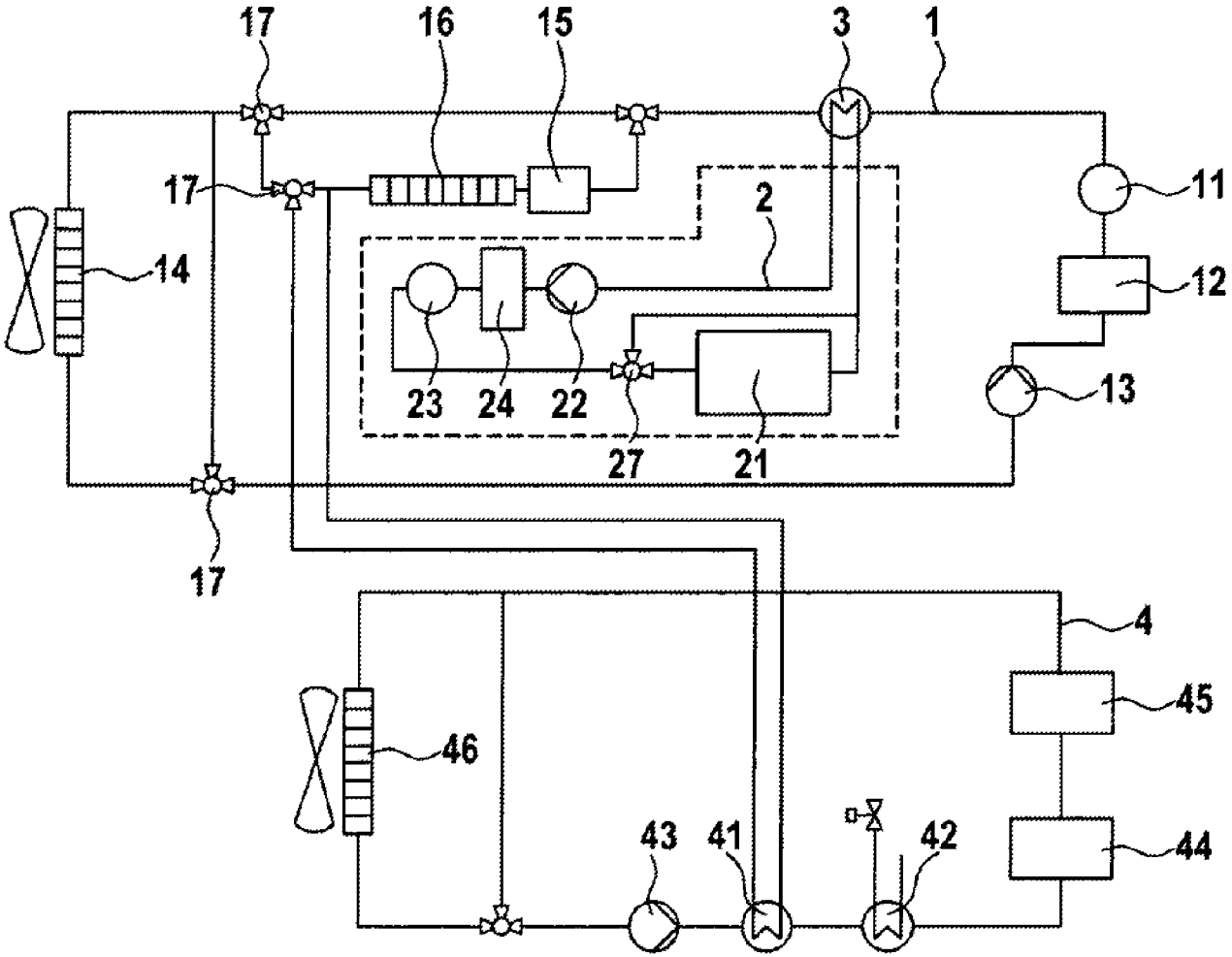
FIG. 2: shows a schematic representation of a topology of a cooling system according to a second illustrative embodiment.

FIG. 2 shows an alternative illustrative embodiment of a topology of a cooling system. This illustrative embodiment is largely identical with the previously described illustrative embodiment from FIG. 1. The illustrative embodiment from FIG. 2 differs from the illustrative embodiment in FIG. 1 inasmuch as the temperature of all the components of the range extender is controlled by the second cooling circuit 2. The coolant in the second cooling circuit 2 is pumped through the second cooling circuit 2 by means of a single pump 22 and, in the process, cools the internal combustion engine 21, the power electronics unit 24 and the generator 23. Here, as in the preceding illustrative embodiment, the second cooling circuit 2 is coupled thermally to the first cooling circuit 1 by means of a heat exchanger 3.

Since, in this illustrative embodiment, the power electronics unit 24 and the generator 23 of the range extender are integrated into the second cooling circuit 2, no additional connection of the range extender to the first cooling circuit 1 is furthermore required. Thus, there is only a single thermal interface by means of the heat exchanger 3 between the first cooling circuit 1 and the second cooling circuit 2.

Here, control of the temperature of the component elements which belong to the branch of the battery system is performed in a manner similar to that in the illustrative embodiment in FIG. 1 by means of a separate cooling circuit 4.

Figure 3:
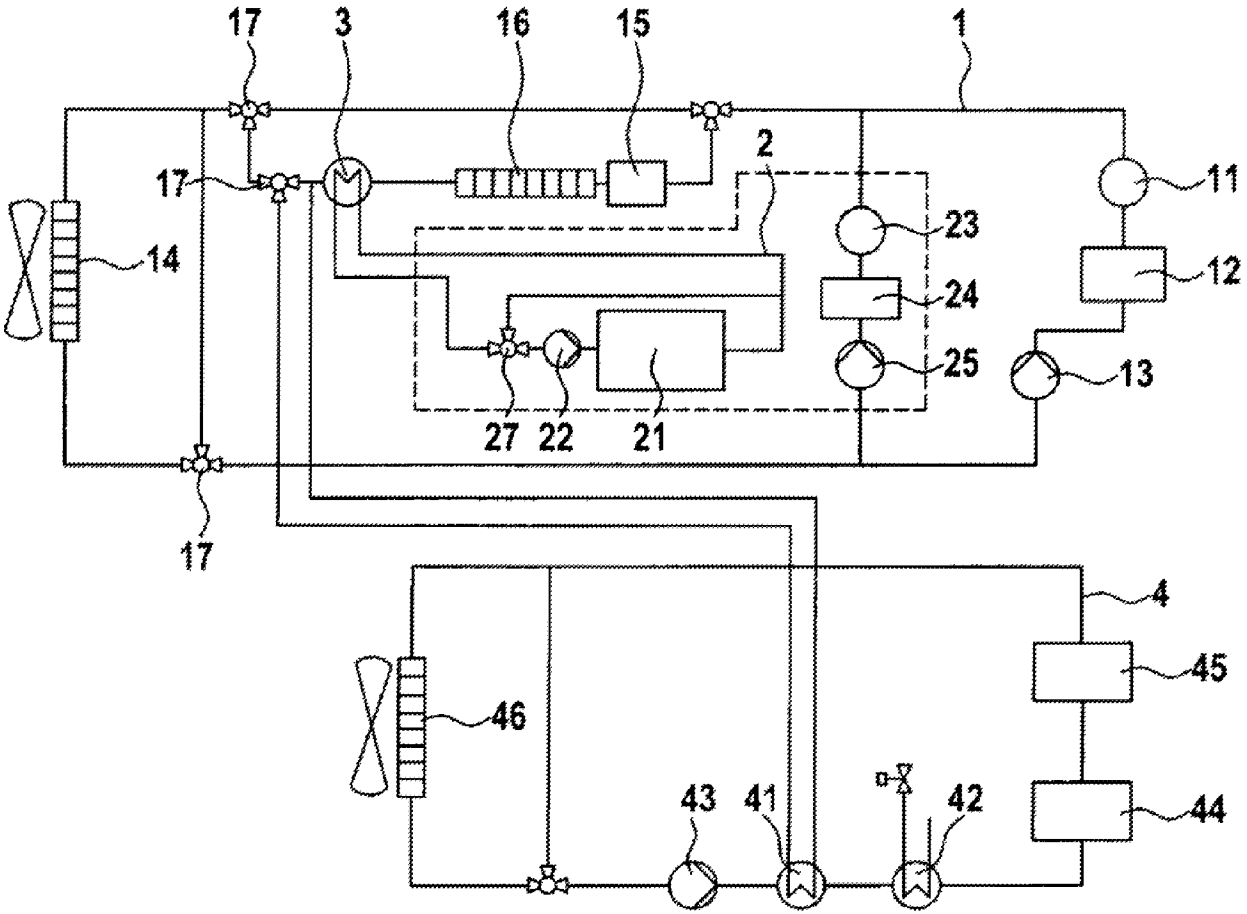
FIG. 3: shows a schematic representation of a cooling system according to a third illustrative embodiment.

FIG. 3 shows another illustrative embodiment of a topology of a cooling system. Here, the illustrative embodiment in FIG. 3 differs from the illustrative embodiment in FIG. 1 inasmuch as the heat exchanger 3 is arranged between the heating device 15 and the heat dissipation device 14, as viewed in the direction of flow of the first coolant. It is thus also possible, especially during starting and during a warm-up phase of the electric vehicle, to feed the heat provided by the heating device 15 directly to the second heating circuit 2 by means of the heat exchanger 3. In this way, the second cooling circuit 2 too can be heated very quickly during the warm-up phase. The internal combustion engine 21 of the range extender can thus be brought very quickly to a desired operating temperature, as a result of which the efficiency of the internal combustion engine 21 increases and wear on the preheated components is reduced and hence the service life extended.

Although the further components of the range extender, such as the generator 23 and the power electronics unit 24, are coupled directly to the first cooling circuit 1 in FIG. 3, it is furthermore likewise possible to combine the illustrative embodiment from FIG. 3 with the illustrative embodiment from FIG. 2. In this case, all the components of the range extender are then integrated into the second cooling circuit 2, wherein the heat exchanger which couples the first cooling circuit 1 to the second cooling circuit 2 is also arranged after the heating device 15, as viewed in the direction of flow of the coolant in the first cooling circuit 1.

Figure 4:
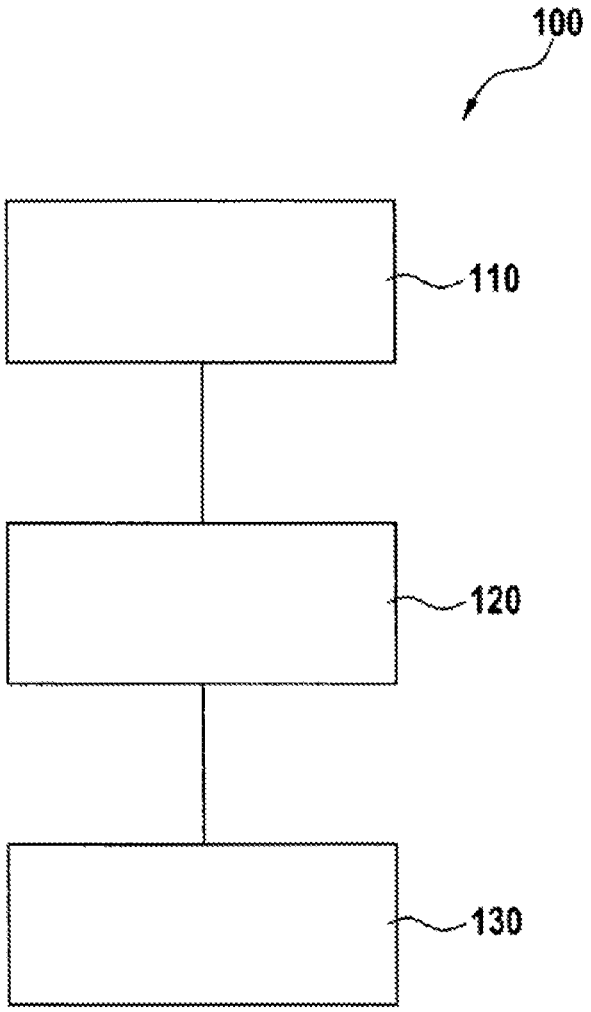
FIG. 4: shows a schematic representation of a method of the kind on which a further illustrative embodiment is based.

FIG. 4 shows a schematic representation of a method 100 for operating a cooling system for an electric vehicle having an electric drive 11 and an internal combustion engine 21, of the kind on which a further illustrative embodiment is based. In step 110, the temperature of the electric drive 11 is controlled by means of a first cooling circuit 1. Depending on the operating state, the electric drive is either cooled or heated during this process in order to achieve the required operating temperature. In step 120, the temperature of the internal combustion engine 22 is controlled by means of a second cooling circuit 2. Here too, the internal combustion engine and, if appropriate, further subassemblies arranged in said cooling circuit can be cooled or heated, depending on the operating state. In step 130, the first cooling circuit 1 and the second cooling circuit 2 are coupled thermally to one another by means of a heat exchanger 3. By means of this thermal coupling, the thermal energy can be transferred in a controlled manner between the first cooling circuit 1 and the second cooling circuit 2. Thus, the first cooling circuit 1, in particular, can also be operated in a temperature range which deviates from the temperature range of the second cooling circuit 2.

In summary, the present invention relates to a concept for the thermal management of an electric vehicle having a range extender. In this context, the temperature of the components of the electric drive system of the electric vehicle and at least that of the internal combustion engine of an internal combustion engine/generator unit of the range extender are controlled by separate cooling circuits. Here, the cooling circuit of the electric drive and the cooling circuit of the internal combustion engine are coupled to one another thermally by means of a heat exchanger. Thus, on the one hand, only one common cooling device is required to release the generated heat to the environment. On the other hand, it is furthermore also possible to take account of the different optimum operating temperatures of the internal combustion engine and of the electric drive system.

What is claimed is:

1. A cooling system for an electric vehicle having an electric drive (11) and an internal combustion engine (21), the cooling system comprising:

a first cooling circuit (1) having the electric drive (11) therein, wherein the first cooling circuit (1) is configured to control the temperature of the electric drive (11);

a second cooling circuit (2) having the internal combustion engine (21) therein, wherein the second cooling circuit (2) is configured to control the temperature of the internal combustion engine (21); and a heat exchanger (3), which couples the first cooling circuit (1) and the second cooling circuit (2) thermally to one another, wherein a first coolant flows through the first cooling circuit (1) and a second coolant flows through the second cooling circuit (2), and wherein the first coolant and the second coolant do not come into contact.

2. The cooling system according to claim 1, wherein at least one of the first coolant and the second coolant is water.

3. The cooling system according to claim 1, wherein the first cooling circuit (1) furthermore has a heat dissipation device (14) therein, wherein the heat dissipation device (14) is configured to release heat from the first cooling circuit (1) into the environment.

4. An electric vehicle, having:

an electric drive (11);

an internal combustion engine (21); and a cooling system according to claim 1.

5. The electric vehicle according to claim 4, having:

a generator (23), which is coupled mechanically to the internal combustion engine (21) and is configured to provide electric energy; and a power electronics unit (24), which is configured to convert the electric energy provided by the generator (23).

6. The electric vehicle according to claim 5, the first cooling circuit (1) furthermore having at least one of the generator (23) and the power electronics unit (14) therein, and wherein the first cooling circuit (1) is furthermore configured to control the temperature of at least one of the generator (23) and the power electronics unit (24).

7. The electric vehicle according to claim 5, the second cooling circuit (2) furthermore having at least one of the generator (23) and the power electronics unit (14) therein, and wherein the second cooling circuit (2) is furthermore configured to control the temperature of at least one of the generator (23) and the power electronics unit (24).

8. The electric vehicle according to claim 4, wherein the first cooling circuit (1) furthermore has a heating device (15) therein, wherein the heating device (15) is configured to heat the coolant in the first cooling circuit (1).

9. The electric vehicle according to claim 8, wherein the heat exchanger (3) is arranged after the heating device (15) as viewed in a direction of flow of the coolant.

10. The cooling system according to claim 2, wherein both of the first coolant and the second coolant is water.

11. The electric vehicle according to claim 6, the first cooling circuit (1) having both of the generator (23) and the power electronics unit (24) therein, and wherein the first cooling circuit (1) is configured to control the temperature of both of the generator (23) and the power electronics unit (24).

12. The electric vehicle according to claim 7, the second cooling circuit (2) having both of the generator (23) and the power electronics unit (24) therein, and wherein the second cooling circuit (2) is configured to control the temperature of both of the generator (23) and the power electronics unit (24).

13. A cooling system for an electric vehicle having an electric drive (11) and an internal combustion engine (21), the cooling system comprising:

a first cooling circuit (1) having the electric drive (11) therein, wherein the first cooling circuit (1) is configured to control the temperature of the electric drive (11);

a second cooling circuit (2) having the internal combustion engine (21) therein, wherein the second cooling circuit (2) is configured to control the temperature of the internal combustion engine (21);

a heat exchanger (3), which couples the first cooling circuit (1) and the second cooling circuit (2) thermally to one another; and a third cooling circuit (4) having a battery (44) therein, wherein the third cooling circuit is configured to control the temperature of the battery (44).

14. The cooling system according to claim 13, wherein the heat exchanger (3) is a first heat exchanger (3), and wherein the cooling system comprises a second heat exchanger (41), which couples the first cooling circuit (1) and the third cooling circuit (4) thermally to one another.

15. A cooling system for an electric vehicle having an electric drive (11), an internal combustion engine (21), a generator (23) which is mechanically coupled to the internal combustion engine (21) and is configured to provide electric energy, and a power electronics unit (24) configured to convert the electric energy provided by the generator (23), the cooling system comprising:

a first cooling circuit (1) having the electric drive (11) therein, wherein the first cooling circuit (1) is configured to control the temperature of the electric drive (11);

a second cooling circuit (2) having the internal combustion engine (21) and at least one of the generator (23) and the power electronics unit (24) therein, wherein the second cooling circuit (2) is configured to control the temperature of the internal combustion engine (21) and the at least one of the generator (23) and the power electronics unit (24); and a heat exchanger (3), which couples the first cooling circuit (1) and the second cooling circuit (2) thermally to one another.

16. The cooling circuit according to claim 15, the second cooling circuit (2) having both the generator (23) and the power electronics unit (24) therein, wherein the second cooling circuit (2) is configured to control the temperature of the generator (23) and the power electronics unit (24).

* * * * *